US005182006A

United States Patent [19]

Haydu et al.

[11] Patent Number: 5,182,006

[45] Date of Patent: Jan. 26, 1993

[54] ZINCATE SOLUTIONS FOR TREATMENT OF ALUMINUM AND ALUMINUM ALLOYS

[75] Inventors: Juan Haydu, Orange; Vincent Paneccasio, Jr., Madison; Patricia A. Cacciatore, Oakville, all of Conn.

[73] Assignee: Enthone-OMI Inc., West Haven, Conn.

[21] Appl. No.: 650,149

[22] Filed: Feb. 4, 1991

[51] Int. Cl.[5] ..... C25D 5/44; B05D 1/18

[52] U.S. Cl. ..... 205/213; 205/244; 205/310; 427/406; 427/436

[58] Field of Search ..... 204/55.1, 55.3, 44.2; 205/213, 245, 246, 310; 106/1.17; 427/305, 406, 436

[56] References Cited

U.S. PATENT DOCUMENTS

| | | | |
|---|---|---|---|
| 4,169,771 | 10/1979 | Creutz et al. | 204/55.3 |
| 4,178,217 | 12/1979 | Glaser et al. | 204/55.1 |
| 4,366,036 | 12/1982 | Lash et al. | 204/55.1 |
| 4,499,123 | 3/1985 | Suzuki et al. | 427/406 |
| 4,536,261 | 8/1985 | Popescu | 204/55.1 |
| 4,983,263 | 1/1991 | Yasuda et al. | 204/44.2 |

*Primary Examiner*—John Niebling

*Assistant Examiner*—Brian M. Bolam

*Attorney, Agent, or Firm*—John J. Tomaszewski

[57] ABSTRACT

A method for producing smooth metal coatings on zincated aluminum substrates using a specially formulated zincating bath containing an additive comprising a bath soluble cationic condensation polymer represented by the general formula:

wherein:

Z represents a group of atoms necessary to complete a heterocylic compound having a five or six membered ring containing at least 2 nitrogen atoms;

R is nothing or the alkyl group of an alkylating agent;

X is Cl, Br or I, and n is $>1$.

13 Claims, 3 Drawing Sheets

ZINCATE SOLUTIONS FOR TREATMENT OF ALUMINUM AND ALUMINUM ALLOYS

BACKGROUND OF THE INVENTION

This invention relates to the metal plating of zincated aluminum and, more particularly, to providing an enhanced adhesive and smooth plating by employing an improved zincate solution to treat the aluminum.

Metal plating of aluminum is of considerable commercial interest and one application is the preparation of memory disks which are used in a variety of electronic applications such as computer and data processing systems. Aluminum is the preferred substrate for the disk although other suitable metals may be employed. In general, a relatively thin layer of nonmagnetic electroless nickel is applied on the aluminum followed by a thin layer of a magnetic material such as cobalt. A signal is stored on the disk by magnetizing the cobalt layer to represent the signal at a selected moment in time.

Typical alloys used for memory disks are Aluminum Association Numbers 5086 and 5586. These disks contain magnesium in an amount of about 4% by weight. Generally, the aluminum disks are about 1.25 to 5 mm. thick and contain, by weight, about 4% to 4.90% magnesium, 0.01% to 0.40% copper, 0.01% to 0.40% zinc, chromium, nickel, iron, silicon and the balance aluminum and inevitable impurities.

The completed metal plated disk must be extremely smooth and uniform so as to prevent "crashing" against the magnetizing head of the device which flies extremely close (generally 5-8 microinches) to the disk surface. While the starting aluminum substrate must itself be extremely smooth and flat as described in U.S. Pat. No. 4,825,680, the metal plating of the disk must likewise be smooth and uniform so that the final disk product meets the exacting specifications required of these type products.

Unfortunately, however, metal plating of a substrate, and even electroless metal plating, does not necessarily produce a smooth coating. Plating voids, inclusions, bridging and the like are only some of the plating problems which can cause a rough surface which is unacceptable for many applications.

Aluminum and its alloys also present additional plating problems because of the rapidity with which they form an oxide coating when exposed to air. As a result, special treatments must be employed when plating on aluminum. These treatments include mechanical treatments; chemical etches, especially acid etches containing iron, nickel, and manganese salts; alkaline displacement solutions, especially those depositing zinc, brass, and copper; anodizing, especially in phosphoric, sulfuric or chromic acids; and electroplating with zinc at low current densities for a few seconds. Of these treatments, the alkaline displacement solutions are generally the most successful commercially.

While many metals such as tin can be deposited on aluminum by displacement, zinc is the most common. In this case, the process is known as the zincate process and the following description will be directed to this process for convenience.

During the years a number of improvements have been made in the conventional zincate formulation and zincating process, with most of them aimed at accelerating the rate of film formation, and the degree of adhesion and uniformity of the zinc coating produced. A detailed summary of the zincating process may be found in Loch, U.S. Pat. No. 4,346,128, and Saubestre, U.S. Pat. No. 3,216,835, which patents are hereby incorporated by reference.

In the conventional zincating process, the aluminum is prepared by alkaline cleaning to remove organic and inorganic surface contaminations such as oil and grease, followed by a cold water rinse. The cleaned aluminum is then sufficiently etched to eliminate solid impurities and alloying constituents which might create voids resulting in bridging of subsequent deposits. After a water rinse, the aluminum is de-smutted to remove metallic residues and aluminum oxides still remaining on the surface. Thorough rinsing is required and then the zincate coating is applied using an immersion zinc bath to prevent re-oxidation of the cleaned surface. This procedure is generally known as a single zincate process.

The zinc coating is obtained by immersion of the aluminum part in an alkaline solution containing zincate ions. The amount of zinc deposited is actually very small and depends on the time and type of immersion bath used, the aluminum alloy, temperature of the solution and the pretreatment process. The zinc coating bath also functions as an etching solution and any oxides reformed during the transferring operations are dissolved by the alkaline zincate while depositing zinc onto the aluminum.

The general procedure now followed by industry is to double zincate whereby the first zinc film is removed using nitric acid followed by application of a second immersion zinc deposit. Double zincating is a preferred method for plating aluminum and is especially useful on certain difficult-to-plate aluminum alloys to ensure better adhesion of the final metal layer deposit.

Despite the acceptance and effectiveness of the zincating processes, the need still exists for an improved process providing both enhanced adhesion and smoothness of the metal plating on the zincated aluminum substrate. Without being limited to theory, it is believed that the properties of the metal plate are directly related to the thickness, uniformity and continuity of the zincate coating with thinner coatings generally providing a smoother and more adhesive metal plating.

It is an object of the present invention to provide a method for preparing aluminum substrate articles having extremely smooth metal plated coatings.

It is a further object of the present invention to provide an improved single and double zincating process for the metal plating of aluminum, which improved process provides a zincate coating which enables an enhanced adhesive metal plating deposit and metal plating smoothness.

It is an additional object to provide improved zincating baths which are used to treat aluminum substrates.

Other objects and advantages will become apparent from the following detailed description.

SUMMARY OF THE INVENTION

It has been found that extremely smooth metal plated aluminum substrates, e.g., memory disks, can be made by employing a zincating process using a special zincating bath containing an effective amount of an additive comprising a bath soluble cationic condensation polymer represented by the general formula:

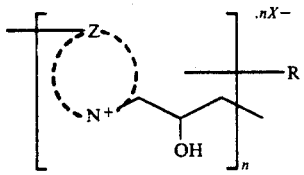

Wherein:

Z represents a group of atoms necessary to complete a heterocylic compound having a five or six membered ring containing at least 2 nitrogen atoms;

R is nothing or the alkyl group of an alkylating agent;

X is Cl, Br or I; and n is>1

This polymer can be obtained by reacting about 0.5 to about 1.0 mol epihalohydrin compound per mol of a heterocyclic compound having a five or six membered ring containing at least two nitrogen atoms. Preferably the polymer is then alkylated with about 0.1 to about 0.5 mol per mol of said heterocyclic compound of any suitable aklylating agent. A preferred alkylating agent corresponds to the formula:

$$[X—R_1—N(R_2)_3]^+X^-$$

Wherein:

$R_1$=ethyl or 2-hydroxypropyl, $R_2$=an alkyl group of 1 to 4 carbons, and

X=Cl, Br or I.

The above additive and method for making and using the additive as a brightener in zinc electroplating solutions is generally described in U.S. Pat. No. 4,169,771, the patent being hereby incorporated by reference.

In the double zincating process for preparing aluminum and aluminum alloys for metal plating the special zincating baths may be used in either zincating step, and is preferably used in both steps. Following conventional procedures, the first zincate film is stripped using nitric acid, the stripped aluminum then water rinsed and coated with a second zincate film. The metal is plated on this second zincate film. Broadly stated, the zincate bath comprises the additive in an effective amount, for example, of about, by volume, 0.1% to 5%.

Following the zincate procedure, the zincated aluminum is plated using conventional procedures.

DETAILED DESCRIPTION OF THE INVENTION

Figure 1:
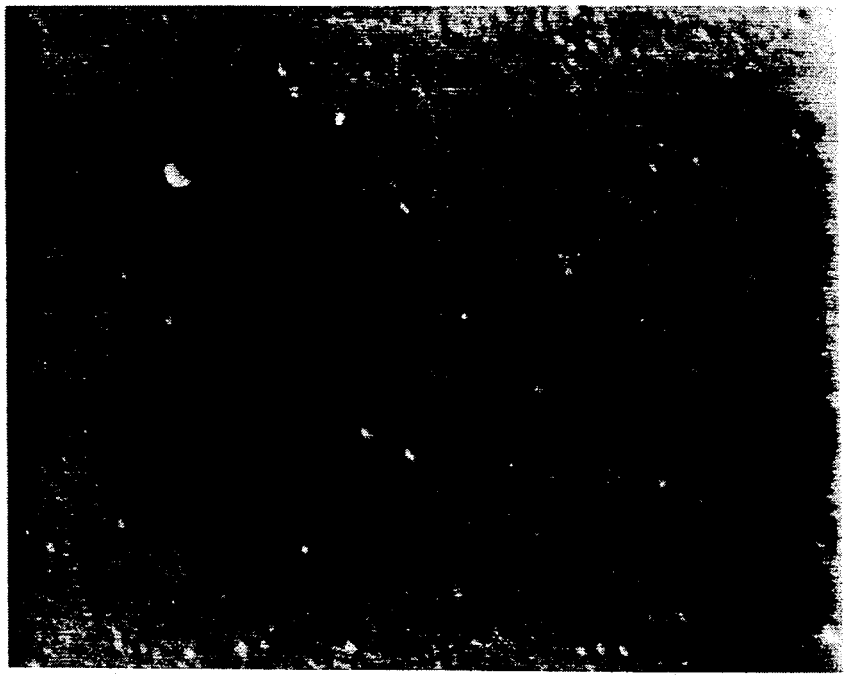
FIGS. 1–5 are photomicrographs at 1000× of electrolessly nickel plated aluminum substrates which were prepared for plating using different double zincating procedures.

The zincate method for preparing aluminum e.g., single, double and triple methods for metal plating is well-known in the art as discussed hereinabove and for convenience the following description will be directed to the double zincating process.

In general, any aluminum or aluminum alloy may be treated using the method of the invention and exemplary alloys are 5086, 5586, 2024 and CZ-46. The aluminum may be wrought or cast.

While the specific double zincate method employed may vary according to the alloys treated and the claimed results, a typical procedure used in industry is as follows and it should be understood that water rinses are generally employed after each processing step.

The first step is usually to clean the aluminum surface of grease and oil and an alkaline nonetch cleaner such as ENBOND (R) NS-35 sold by Enthone-OMI, Inc., West Haven, Connecticut, may be suitably employed. ENBOND NS-35 is a nonsilicated mildly alkaline cleaner used over a temperature range of about 49° to 66° C. for 1 to 5 minutes.

Etching of the cleaned aluminum may then be performed using etchants such as ACTANE (R) E-10, ENBOND E-14 or ENBOND E-24, all of which are sold by Enthone-OMI. These materials are either acidic or alkaline. The acid etchant is generally preferred particularly when surface dimensions, tolerances and integrity are important. The etchants are generally used at elevated temperatures of about 49° to 66° C. for 1 to 3 minutes.

De-smutting of the alloy may be performed using a $HNO_3$ solution (for example 50% by volume) or mixtures of $HNO_3$ and $H_2SO_4$ alone or in combination with ACTANE 70 sold by Enthone-OMI. ACTANE 70 is an acidic, fluoride salt product containing ammonium bifluoride. A typical de-smutting solution contains 25% by volume $H_2SO_4$, 50% by volume $HNO_3$ and 1 lb./gallon ACTANE 70 in water.

It is at this point that a zincate coating is applied to the aluminum by immersion in a zincate bath as described in Saubestre, U.S. Pat. No. 3,216,835, supra. Due to its demonstrated effectiveness, a preferred bath to employ the additive in is ALUMON (R) EN sold by Enthone-OMI. ALUMON EN and in general zincate baths contain an alkali metal hydroxide, a source of zinc ions such as a zinc salt (such as zinc oxide, zinc sulfate, etc.), a chelating agent, optionally anionic wetting agents and metallic additives. Other commercial zincate baths can suitably be employed.

Generally, the double zincate process involves immersion of the aluminum substrate in a dilute zincate bath such as an ALUMON (R) EN for a period of 20–50 seconds followed by a thorough cold water rinse, a zinc stripping operation in nitric acid, a further cold water rinse, and a second zincate immersion and subsequent rinse. In the single zincate process, the substrate is ready for plating after the first zincating and rinsing step and likewise, in the triple zincating process, the double zincated surface is treated with $HNO_3$ and again zincated followed by a thorough cold water rinse.

A preferred additive of the invention is lH-imidazole, polymer with (chloromethyl) oxirane and an especially preferred additive is the above oxirane alkylated with [3-chloro-2-hydroxypropyl]trimethylammonium chloride (termed IEA). IEA may be prepared by forming an aqueous solution containing 0.9 mols imidazole and 0.91 mols epichlorohydrin which is heated to a temperature of about 95o C. for a period of 15 hours. Thereafter, 0.45 mols of (3-chloro-2-hydroxypropyl) trimethylammonium chloride is added and heating of the reaction mixture is continued for an additional period of one hour to compete the alkylation reaction.

The additive may be employed in varying amounts, by volume, of about 0.1% to 5% or higher. A preferred level is about 0.3 to 3% and a highly preferred concentration is 1 to 2.5%. A level of about 2% or higher has been found particularly effective since the additive does not need to be replenished during the normal life of the bath.

The preferred alkylating agent corresponds to the formula:

$$[X—R_1—N(R_2)_3]^+X^-$$

but any suitable alkylating agent may be employed. Exemplary classes of quaternary alkylating agents are chlorohydrin, alkyl halides and heterocyclic alkyl halides. Specific examples are (3 - chloro - 2 -hydroxypropyl) methylmorpholonium chloride; (2-bromoethyl) trimethylammonium bromide and (2-bromo pyridinium bromide. Other $X_{31}$ anions include methosulfate and p-toluene sulfonate.

The nitric acid solution used to strip the zincate coating is generally a 50% by volume solution with a range of concentration being generally about 350 to 600 g/1, and preferably about 450 to 550 g/1.

The nitric acid solution may be employed at any suitable temperature, usually about 20° to 25° C. or higher and preferably 21° to 23° C. Immersion times may vary from about 30 to 90 seconds and preferably about 40 to 60 seconds.

A preferred procedure for stripping the zincated surface is to use a nitric acid solution containing ferric ions as disclosed in co-pending commonly owned U.S. Pat. application No. 07/420,805, filed Oct. 12, 1989, said application being incorporated herein by reference.

After $HNO_3$ stripping the aluminum is again treated with a zincate bath to prepare the substrate for plating. The additive material may be used in any or, preferably, all of the zincate baths used to treat the aluminum.

It will be understood by those skilled in the art that the concentration, solution temperature and immersion time are interrelated and that, in general, the higher the temperature and concentration, the shorter the immersion time necessary to achieve the desired surface effect, with the invention residing in the use of the above additive in the zincate bath to provide the enhanced adhesion and smoothness of the subsequent metal plating.

While other metals may now be plated electrolessly, electrolytically or combinations thereof on the specially prepared zinc coated aluminum, the following description will be specifically directed to electroless nickel because of its commercial importance.

Electroless nickel plating compositions for applying the nickel coatings are well known in the art and plating processes and compositions are described in numerous publications. For example, compositions for depositing electroless nickel are described in U.S. Pat. Nos. 2,690,401; 2,690,402; 2,762,723; 2,935,425; 2,929,742; and 3,338,726. Other useful compositions for depositing nickel and its alloys are disclosed in the 35th Annual Edition of the Metal Finish Guidebook for 1967, Metal and plastics publications Inc., Westwood, N.J., pages 483–486. Each of the foregoing publications are included herein by reference.

In general, electroless nickel deposition solutions comprise at least four ingredients dissolved in a solvent, typically water. They are (1) a source of the nickel ions, (2) a reducing agent such as a hypophosphite or an amine borane, (3) an acid or hydroxide pH adjustor to provide the required pH and (4) a complexing agent for metal ions sufficient to prevent their precipitation in solution. A large number of suitable complexing agents for electroless nickel solutions are described in the above noted publications. It will be appreciated by those skilled in the art that the nickel, or other metal being applied, is usually in the form of an alloy with the other materials present in the bath. Thus, if hypophosphite is used as the reducing agent, the deposit will contain nickel and phosphorous. Similarly, if an amine borane is employed, the deposit will contain nickel and boron. Thus, use of the term nickel includes the other elements normally deposited therewith.

The zinc coated aluminum part may be plated with the electroless nickel bath to the desired thickness or multiple baths may be used as is known in the art.

It will be appreciated by those skilled in the art that the rate of plating may be influenced by many factors including (1) pH of the plating solution, (2) concentration of reductant, (3) temperature of the plating bath, (4) concentration of soluble nickel, (5) ratio of the volume of bath to the area plated, (6) presence of soluble fluoride salts (rate promoters) and (7) presence of wetting agent and/or agitation, and that the above parameters are only provided to give general guidance for practising the invention; the invention residing in the use of the special zincate baths as hereinbefore described to provide an enhanced smooth metal coating on the zincated aluminum substrate.

The composition and process of the present invention will now be more fully illustrated by the following specific examples which are illustrative and in no way limitative and wherein all parts and percentages are by weight and temperatures in degrees centigrade unless otherwise noted.

EXAMPLE I

Aluminum alloy 5586 disks were double zincated and plated with electroless nickel using the following procedure (a cold water rinse followed each of the steps):

(1) Immerse in ENBOND NS-35 (50% by volume) for 3 minutes at 60° C.;

(2) Immerse in ACTANE E-10 (10% by volume) for 1 minute at 60° C. (micro-etch);

(3) Immerse in 50% by volume $HNO_3$ for 1 minute at room temperature (desmut);

(4) Immerse in ALUMON EN (25% by volume) for 35 seconds at room temperature;

(5) Immerse in 50% by volume $HNO_3$ for 1 minute at room temperature;

(6) Immerse in ALUMON EN (25% by volume) for 16 seconds at room temperature;

(7) Immerse in ENPLATE ADP-300 for 1 hour at 84°–87° C. (pH 4.5±0.1).

ENPLATE ADP-300 is an acidic based (pH 4.6) electroless nickel bath containing, in g/1, nickel sulfate hexahydrate (26), sodium hypophosphite (20), sodium lactate (60%) (71), malic acid (11.8), sodium hydroxide (4.6), potassium iodate (0.015), lead nitrate (0.0003) and an anionic surfactant (0.02).

FIG. 1 shows the nickel surface resulting from using the above conventional double zincating procedure.

The same procedure was used for the following metal platings with the noted changes.

Figure 2:
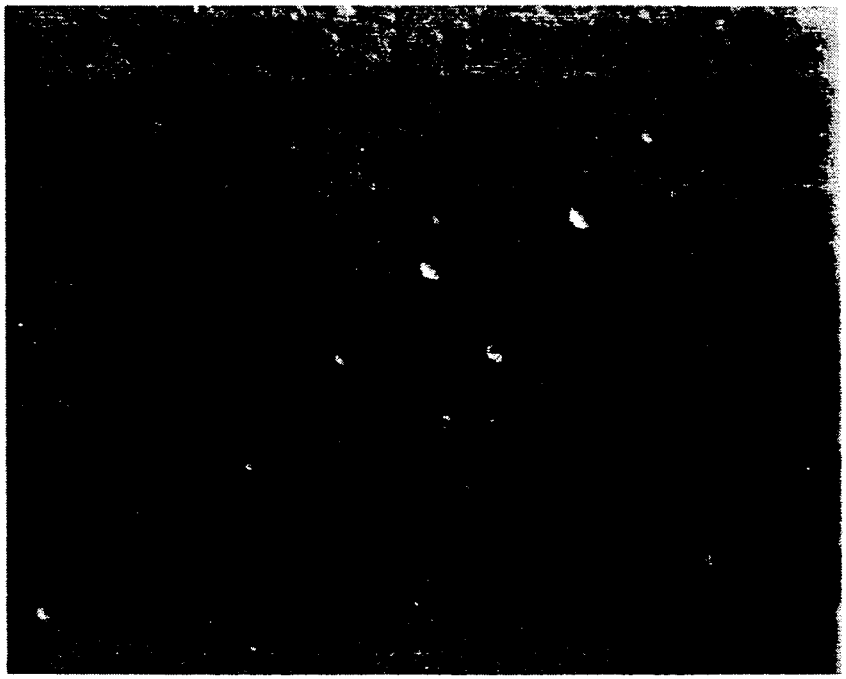

FIG. 2 used 1% by volume of the additive IEA in the zincate solution of step (4).

Figure 3:
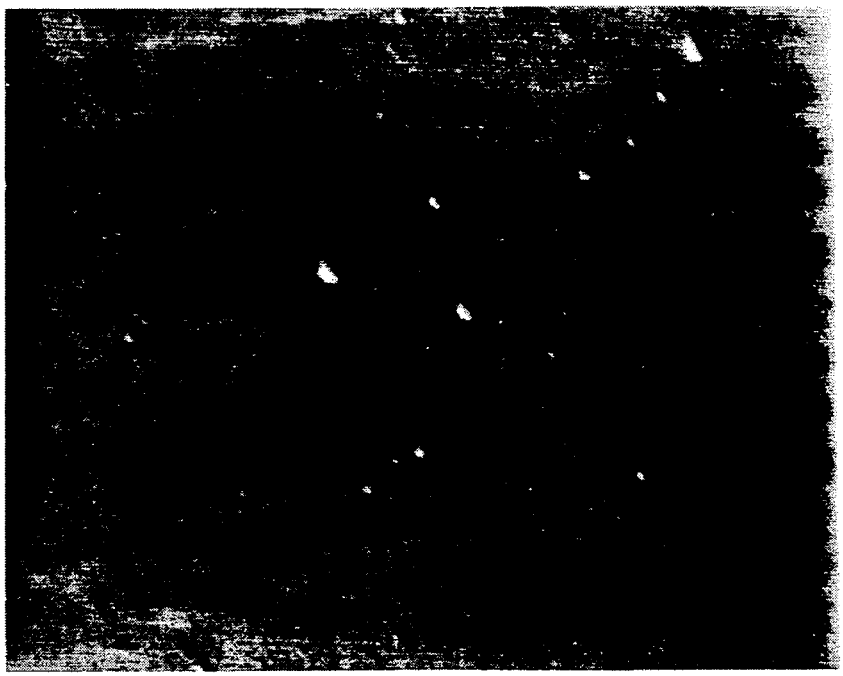

FIG. 3 used 1% by volume of the additive IEA in the zincate solution of step (6).

Figure 4:
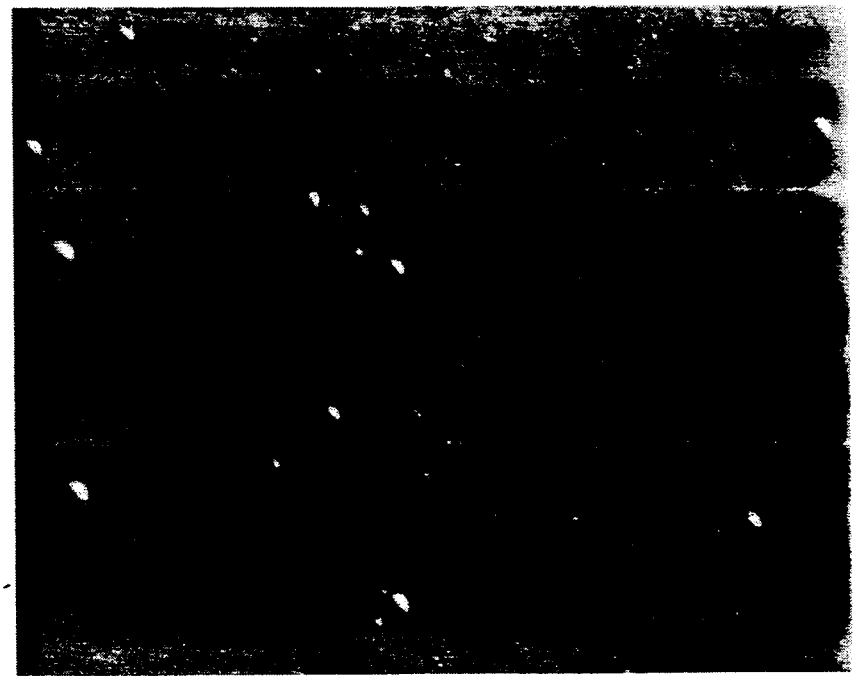

FIG. 4 used 1% by volume of the additive IEA in the zincate solutions of both steps (4) and (6).

Figure 5:
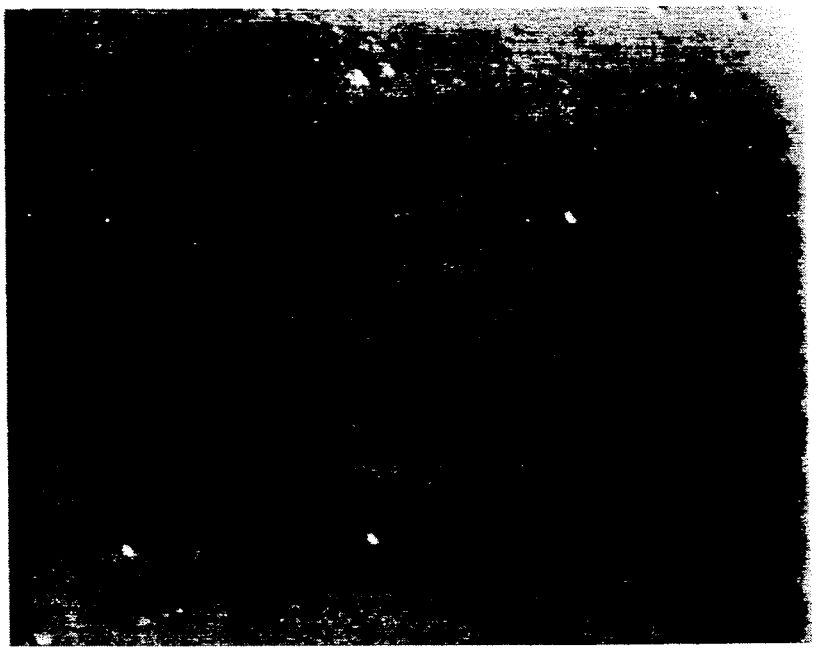

FIG. 5 is the same procedure as used for FIG. 4 except 0.5 g/1 ferric ions were employed in the $HNO_3$ solution of step (5).

The figures clearly show that use of the additive of the invention in the zincating solution improves the smoothness and brightness of the nickel plating compared to the conventional process, with the preferred process being the use of both ferric ions in the $HNO_3$ solution and the additive in each of the zincate solutions.

EXAMPLE II

Steps 1, 2, 3 and 4 of EXAMPLE I were repeated using (1) the conventional ALUMON EN baths; (2) 0.5% by volume of an additive (prepared in the same manner to produce IEA except that the resultant polymer ($R_2$ is nothing) was not alkylated) in the ALUMON EN bath of step (4); and (3) 0.5% by volume of IEA in the ALUMON EN bath of step (4). The zincated panels were then completely stripped of zinc by immersion in 50% by volume $HNO_3$ for five minutes at 25° C. The conventional zincate procedure (without additive) had 0.40 mg/inch2 zinc compared to 0.34 and 0.29 for additive baths (2) and (3), respectively. These results show the use of the additives produces a thinner zinc coating which it is hypothesized provides a zincated surface which, when plated, is smoother and brighter.

EXAMPLE III

Aluminum alloy 2024 disks were zincated using the following procedure:

(1) Immerse in ENBOND NS-35 (50% by volume) for minutes at 60° C;

(2) Cold water rinse;

(3) Immerse in ACTANE E-10 (10% by volume) for 1 minute at 60° C.;

(4) Cold water rinse;

(5) Immerse in ALUMON EN (25% by volume) for 36 seconds at room temperature;

(6) Cold water rinse;

(7) Hot air dry.

Figure 6:
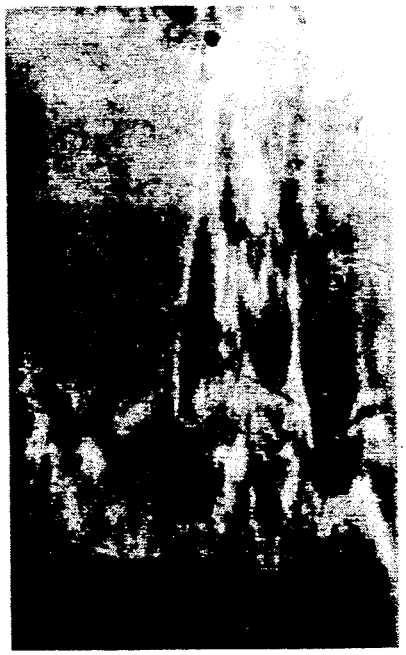
FIGS. 6–7 are photographs of a zincated aluminum surface prepared using a conventional zincating bath and a zincating bath of the invention.

FIG. 6 shows the zincated surface resulting from using the above conventional zincating procedure.

Figure 7:
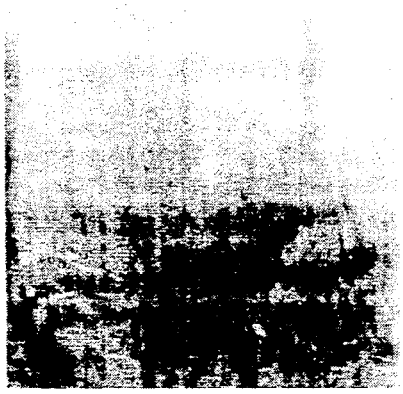

FIG. 7 shows the zincated surface resulting from using the same procedure as for FIG. 6 except that 1%, by volume, of IEA was added to the zincate solution of step (5). The difference in zincate coating between the figures is readily apparent and demonstrates the beneficial effect on smoothness of the zincated surface when using the additive of the invention in the zincating solution.

It will be apparent that many changes and modifications of the several features described herein may be made without departing from the spirit and scope of the invention. It is therefore apparent that the foregoing description is by way of illustration of the invention rather than limitation of the invention.

We claim:

1. A method for depositing a smooth metal coating on an aluminum substrate comprising:

(a) applying an immersion zincate coating on the aluminum by immersing the aluminum in a zincate bath comprising an effective amount of an additive represented by the formula:

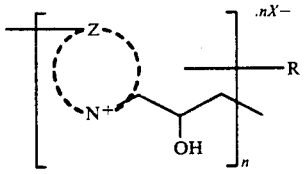

wherein:

Z represents a group of atoms necessary to complete a heterocyclic compound having a fixe or six membered ring containing at least 2 nitrogen atoms;

R is nothing or the alkyl group of an alkylating agent;

X is Cl, Br or I; and n is $>1$;

(b) plating the zincated aluminum substrate using an electroless or electrolytic metal plating bath.

2. The method of claim 1 wherein Z is a group of atoms forming an imidazole ring.

3. The method of claim 2 wherein $R_2$ is nothing.

4. The method of claim 1 wherein the heterocyclic compound is a bath soluble cationic alkylated condensation polymer obtained by alkylation of a polymer prepared by the reaction of from about 0.5 to about 1.0 mol epihalohydrin compound per mol of a heterocyclic compound having a five or six membered ring containing at least two nitrogen atoms, which polymer is then alkylated with about 0.1 to about 0.5 mol per mol of said heterocyclic compound of an alkylating agent corresponding to the formula:

$$[X—R_1—N(R_2)_3]^{+-}$$

wherein:

$R_1$=ethyl or 2-hydroxypropyl, $R_2$=an alkyl group of 1 to 4 carbons, and

X=Cl, Br or I.

5. The method of claim 4 wherein the additive is the polymer reaction product of imidazole and epichlorohydrin.

6. The method of claim 5 wherein the additive is in an amount of, by volume, about 0.1 to 5%.

7. The method of claim 4 wherein the additive is the polymer reaction product of imidazole and epichlorohydrin alkylated with 3-chloro-2-hydroxy-propyltrimethyl ammonium chloride.

8. The method of claim 7 wherein the additive is in an amount of about, by volume, 0.1 to 5%.

9. In the double zincating process for preparing aluminum and aluminum alloys for metal plating wherein the aluminum after pretreatment is zincated by immersion in a zincating bath, the zincated aluminum is then immersed in a nitric acid bath to remove at least part of the zincate coating, followed by immersion in a zincating bath to zincate the aluminum and metal plating of the zincated aluminum, the improvement comprising employing in either or both of the zincating baths an effective amount of an additive comprising a bath soluble cationic alkylated condensation polymer obtained by alkylation of a polymer prepared by the reaction of from about 0.5 to about 1.0 mol epihalohydrin compound per mol of a heterocyclic compound having a five or six membered ring containing at least two nitrogen atoms, which polymer is then alkylated with about 0.1 to about 0.5 mol per mol of said heterocyclic compound of an alkylating agent corresponding to the formula:

$$]X—R_1—N(R_2)_3]^+X^-$$

wherein:

$R_1$=ethyl or 2-hydroxypropyl, $R_2$=an alkyl group of 1 to 4 carbons, and

X=Cl, Br or I.

10. The method of claim 9 wherein the additive is the reaction polymer product of imidazole and epichlorohydrin.

11. The method of claim 10 wherein the additive is the reaction polymer product alkylated with 3-chloro 2-hydroxy-propyl-trimethyl ammonium chloride.

12. The method of claim 10 wherein the additive is in an amount of about, by volume, 0.1% to 5%.

13. The method of claim 11 wherein the additive is in an amount of about, by volume, 0.1% to 5%.

* * * * *